United States Patent [19]

Silberman et al.

[11] 4,285,533

[45] Aug. 25, 1981

[54] APPARATUS FOR CARRYING FIRST AND SECOND WEIGHT LOADS OF A TUBING STRING

[75] Inventors: Raphael J. Silberman; Everett H. Smith, both of Houston, Tex.

[73] Assignee: Baker International Corporation, Orange, Calif.

[21] Appl. No.: 36,910

[22] Filed: May 7, 1979

[51] Int. Cl.[3] ..... E21B 17/06

[52] U.S. Cl. ..... 285/2; 166/242; 166/315; 285/3

[58] Field of Search ..... 166/315, 313, 189, 212, 166/208, 237, 117.7, 238, 339, 154, 321, 322, 242; 285/2, 3, 4, 18, 23, 39; 407/2, 3, 12; 294/86.24; 64/12, 3

[56] References Cited

U.S. PATENT DOCUMENTS

| | | | |
|---|---|---|---|
| 2,994,280 | 8/1961 | Daffin | 285/2 |
| 3,603,401 | 9/1971 | Nelson | 166/313 |
| 4,067,385 | 1/1978 | Schwager | 166/313 |
| 4,143,712 | 3/1979 | James et al. | 166/313 |

*Primary Examiner*—William F. Pate, III

*Attorney, Agent, or Firm*—William C. Norvell, Jr.

[57] ABSTRACT

An apparatus is provided which is connectable on a tubing string extendible into a subterranean well. The apparatus is selectively separatable whereby the tubing string may be parted. The apparatus comprises first means selectively retrievable from the apparatus for carrying across the apparatus a first weight load defined through the tubing string below the apparatus. Second weight load carrying means are provided for carrying across the apparatus a second weight load defined through the tubing string below the apparatus, the second weight load being less than the first weight load. The second means are activatable to separate the apparatus and the tubing string when the second weight load is exceeded.

6 Claims, 3 Drawing Figures

APPARATUS FOR CARRYING FIRST AND SECOND WEIGHT LOADS OF A TUBING STRING

CROSS-REFERENCE TO RELATED APPLICATIONS

This application is related in subject matter to co-pending applications: Ser. No. 36,963, filed May 7, 1979, entitled "Method And Apparatus For Rotating Tubing Conduits"; Ser. No. 36,908, filed May 7, 1979, entitled "Latch Assembly And Method"; Ser. No. 36,909, filed May 7, 1979, entitled "Control Tool"; and Ser. No. 36,964, filed May 7, 1979, entitled "Single Trip Tubing Hanger Assembly", each of said co-pending applications being assigned to the same assignee as the present application.

BACKGROUND OF THE INVENTION

1. Field of the Invention

The invention relates to a method and apparatus for selectively carrying first and second weight loads of a tubing string in a subterranean well, and for separating said tubing string through the apparatus when the second weight load is exceeded.

2. Description of the Prior Art

In the production of well fluids, such as oil and/or gas, from wells, it has been the practice to provide automatically closeable shut-off or safety valves which are located downhole in the well and are held open by control fluid pressure, the valves closing automatically when control fluid pressure is purposely reduced to allow the valves to close or damage occurs to the control fluid system at the well head or on an offshore platform. Such valves are employed below the well head, and in the case of offshore wells, the valves are installed below the mud line at such depth as may be desired or established by regulation, so that in the event of damage of the well caused by shifting earth or subsidence, or well head catastrophe, the well can be shut in to avoid loss of valuable well fluids into the water, and also, to avoid contamination of the water and the shore.

Many offshore wells are produced from spaced well zones through separate strings of production tubing, and a safety or shut-off valve is required for each zone. Since, from time-to-time, it is necessary to perform various remedial operations through the tubing strings, it is preferred that the safety valves be easily removed from the well for service or repair. Accordingly, commercially available safety or shut-off valves have been provided which have been run into the well casing on production tubing and landed in a tubing hanger which supports the greater weight of the downwardly extending production tubing strings. Typically, such a tubing hanger has been run into the well casing on a setting tool to a desired location, and, in the case of an offshore well, to a prescribed depth below the mud line. In such an apparatus, the tubing hanger is anchored in the well casing and the setting tool is released from the tubing hanger and removed from the well. The tubing hanger provides a seat for the safety or shut-off valve assembly which is run into the well on an upward extension of the production tubing and landed in the tubing hanger, subsequent to the setting of the hanger and retrieval of the hanger setting tool.

Typical of such prior art apparatuses is that as disclosed in U.S. Pat. No. 3,771,603, issued Nov. 13, 1973, entitled "Dual Safety Valve Method And Apparatus", to Talmadge L. Crowe, the disclosure of which is hereby incorporated herein by reference. The necessity of two trips into the hole with work strings and/or other means to first carry and anchoringly set the tubing hanger and thereafter land the conduits containing the safety valves therein is an economic deterrent since considerable rig time is expended in running a first work string and/or other means for anchoring the hanger, retrieving the work string and/or other means, and thereafter running the production tubing containing the safety valve or valves into sealing engagement with the hanger.

In co-pending application Ser. No. 36,964, filed May 7, 1979, entitled "Single Trip Tubing Hanger Assembly", there is disclosed a latch assembly used in conjunction with a tubing hanger carried on upper production tubing strings, the production strings typically carrying safety valves to control well production fluid transmission therethrough. The present invention is directed to a unique shear-out safety joint apparatus which, for example, may provide a means of separating the tubing conduit below the safety valve means when a predetermined load across the shear-out safety joint is exceeded, and also provides a bridge so that a weight load up to the full production tubing strength initially can be carried for a preliminary operation, such as the setting of a packer apparatus below the hanger assembly. Thereafter, the bridge may be removed and the load capability of the shear-out safety joint apparatus is relaxed.

SUMMARY OF THE INVENTION

The present invention provides a unique shear-out safety joint for carrying a first weight load thereacross and manipulatable to reduce the weight load carried thereacross and shearably part when the reduced weight load is exceeded. Such shear-out safety joint has particular adaptability when incorporated in a one trip hanger apparatus for utilization in a subterranean well having plural productive zones and wherein plural tubing strings extending from the top of the well are landed within and carried on a tubing hanger having companion plural production tubing string lower sections extending therefrom and respectively communicating with the production zones within the well, the tubing hanger means being anchorably engaged onto the wall of the well casing with the upper production tubing strings landed and carried therein. Utilization of the present shear-out safety joint permits carriage during insertion of the production tubing string conduits with the hanger assembly with the shear-out safety joint carrying the entire weight load defined by the upper and lower production tubing strings and the hanger assembly, together with the integrated component parts carried thereon, such as plural safety valves carried on the upper production tubing strings above the hanger means. The shear-out safety joint has first means selectively retrievable from the shear-out safety joint for carrying across the shear-out safety joint a first weight load defined through the tubing string below the shear-out safety joint. Second weight load carrying means are provided for carrying across the shear-out safety joint a second weight load defined through the tubing string below the apparatus, the second weight load being less than the first weight load and the second means being activatable to separate the apparatus and the tubing string when the second weight load is exceeded. Typically, the first selectively retrievable means comprises a collet assembly held in place to the housing by means of a bridge or mandrel which is manipulatable by auxiliary means, such as a wireline or an auxiliary work string, to shift the collet assembly relative to the housing and remove same. Preferably, the second weight load carrying means may be a shear pin extending within and between sections of the outer housing of the shear-out safety joint.

DESCRIPTION OF THE PREFERRED EMBODIMENTS

Figure 1:
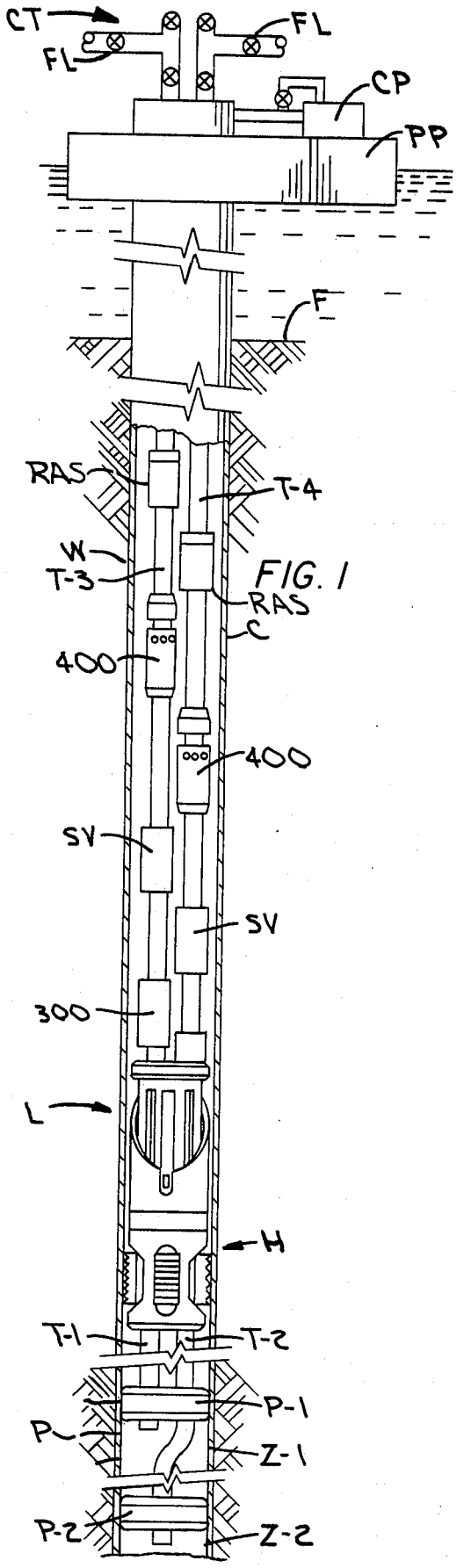
FIG. 1 is a diagrammatic illustration showing a single trip tubing hanger assembly installed in a well casing extending through vertically spaced productive well zones which are isolated from one another by packers, and from which well fluids are produced through a pair of production tubing strings.

Referring now to FIG. 1, a well bore W extends downwardly into the earth below the ocean floor F through vertically spaced well fluid producing zones Z-1 and Z-2. A casing C is set in the well bore and perforations P in the casing establish communication between the production zones Z-1 and Z-2 and the casing C. Set in the casing C is an upper packet P-1 located above the production zone Z-1 and a lower packer P-2 located in the casing between the production zones Z-1 and Z-2. A first production tubing string T-1 extends from a tubing hanger H through the packer P-1 and opens into the casing therebelow to communicate with the production zone Z-1, and a second production tubing T-2 extends downwardly from the tubing hanger H through the upper packer P-1 and downwardly through the lower packer P-2 into the casing therebelow for communication with the production zone Z-2. The tubing strings T-1 and T-2 may extend a number of thousands of feet downwardly in the casing C to the packers P-1 and P-2, and the tubing strings T-1 and T-2 are supported by the tubing hanger assembly H which is set or anchored in the well casing and forms a seat for plural safety valves SV for the respective tubing strings T-1 and T-2. The hanger assembly H and the valve assemblies SV are located below the ocean floor F or the mud line of a body of water, at a desired or required depth of about 500 to 1,000 feet, more or less. The casing C extends upwardly through the water to a production platform or barge PP. However, as is well known, the well may be completed at the ocean floor and one or a number of additional casings (not shown) may be set in larger diameter well bores, and the casing C may be suspended or hung from a casing hanger located at the ocean floor, in which case a conductor pipe or other casing (not shown) may extend to the production platform PP. In any event, upper production fluid tubings T-3 and T-4 extend upwardly from the hanger assembly H and are connected with christmas trees CT on the platform PP whereby the flow of well fluids from the well zone Z-1 and Z-2 may be controlled or manually shut off. Flow lines FL are provided to conduct well fluids from the christmas tress CT to suitable reservoirs or tanks (not shown).

The respective subsurface safety valves SV, which are normally closed, are adapted to be held open, to enable the flow of production fluids therethrough, by means of control fluid pressure supplied through a control fluid conduit (not shown), or through a pair of such conduits, from a source of control fluid pressure at a control panel CP on the platform PP. So long as the control fluid pressure is adequate to maintain the subsurface valves SV open, well fluids may flow from the zone Z-1 and Z-2 to the respective flow lines FL, but, if it is desired for any reasons to close either of the shut-off valves SV, or in the event of damage of the control fluid tubing, the control fluid pressure may be varied so that the subsurface valves SV are automatically closed, thereby shutting the well in at a location below the ocean floor, to prevent continued production fluid flow.

The valve assemblies SV may be retrieved from the tubing hanger apparatus H so that under circumstances requiring repair or service of the valves SV, it is not necessary to pull the production tubing strings T-1 and T-2. Since only the comparatively short upper production tubing strings T-3 and T-4 need be pulled, selectively, or together, from the well to remove one or more of the valves SV, and the substantially longer production tubing strings T-1 and T-2 remain in the well, the platform PP need not be equipped with or supplied with high-powered hoisting apparatuses. Instead, the platform PP may simply be provided with a small relatively low-powered hoist mechanism or a gin pole hoist. In addition, the tubing strings T-1 and T-2 may be plugged off at or below the hanger H with bypass plugs in sealing nipples to enable the service or repair of the safety valves SV, without requiring that the well be killed.

The tubing strings T-3 and T-4 are sealingly engaged within a split surface hanger (not shown) below the christmas tree CT and adaptable to be landed within the casing C in a profile or surface hanger bowl (not shown) subsequent to anchoring engagement of the hanger assembly H. The split surface hanger is utilized to suspend the tubing weight from the tubing head on the platform PP and the surface hanger bowl carries the tubing weight above the tubing hanger H when the split surface hanger is in position within the bowl.

Referring to FIG. 1, one or both of the tubing strings T-3 and T-4 may carry rotational adjustment subs RAS somewhat below the split surface hanger in order to space out the tubing strings T-3 and T-4 from the surface hanger to the tubing hanger H to permit extension or contraction of the tubing length prior to setting of the hanger H. As an alternative to utilization of a rotational adjustment sub RAS, a conventional slip joint may be incorporated into one or both of the Strings T-3 and T-4.

Below the rotational adjustment subs RAS on each of the strings T-3 and T-4 is defined a shear-out safety joint 400 which is utilized to part the respective tubing strings T-3 and T-4 above the safety valve SV for retrieval to the top of the well W in the event of a disaster. The shear-out safety joints 400 automatically separate when the weight load strength of the tubing string is exceeded, or other predetermined load carried therethrough.

Below the shear-out safety joints 400, and at a depth below the ocean or other floor F, are conventional tubing mounted or wireline safety valves SV carried on each of the tubing strings T-3 and T-4. The utilization of any particular tubing mounted or wireline safety valves is not critical to the present invention. The safety valves SV utilized with the present invention may be those as described in detail in U.S. Pat. No. 3,771,603, the disclosure of which is herein incorporated by reference.

One or more of the tubing strings T-3 and T-4 may carry optional swivel subs 300 spaced thereon and below the safety valves SV as an alternate means to mechanically disengage the latch L from the tubing hanger H.

Below the swivel subs 300 is the tubing hanger H which is provided to anchor against the interior wall of the casing C and thereafter carry the weight of the tubing strings T-1 and T-2 therebelow. Seating nipples (not shown) are carried on the tubing strings T-1 and T-2 below the tubing hanger H and are provided with seal surfaces for receipt of plugging means (not shown) which are landed therein by wireline prior to unlatching of the latch L from the tubing hanger H or, prior to the setting of the tubing hanger H.

This, it can be seen that the tubing hanger assembly generally comprises an upper space-out section, consisting of tubing strings T-3 and T-4 and component parts carried thereon, a tubing hanger H receiving the latch assembly L, and the lower section, consisting of the tubing hanger H and tubing strings T-1 and T-2, and component parts carried thereon.

The hanger H utilized in the present invention is adapted to latchingly and sealingly receive the upper production tubing strings at its uppermost end and is anchoringly engageable upon the casing C exteriorly defined therearound, in order to transfer the weight of the tubing strings T-1 and T-2 therebelow to the casing C, this permitting retrieval of the space-out section 100A without retrieval of the tubing strings T-1 and T-2 therebelow. The tubing hanger H is of known design and is as disclosed in detail in U.S. Pat. No. 3,771,603.

Now referring to FIGS. 1, 2, and 3, the shear-out safety joint 400 is schematically illustrated on each of the tubing strings T-3 and T-4 spaced somewhat below each of the rotational adjustment subs RAS and above the safety valves SV. It is not essential in the operation of the assembly of the present invention to incorporate one or more shear-out safety joints 400 in the space-out section 100A, the function of the shear-out safety joint 400 being to provide a means of separating the tubing string above the safety valves SV when a predetermined weight load across the shear-out safety joint 400 is exceeded. Alternatively, the safety joint 400 may be excluded from incorporation within the components defining the space-out section. However, when a shear-out safety joint is utilized in the one trip tubing hanger assembly of the present invention, it is mandatory that such joint provide for carriage of a weight load up to the full tubing strength of each of the combined tubing sections T-1 and T-3, T-2 and T-4, in order to facilitate a preliminary operation prior to the setting of the tubing hanger H, such as the setting of the packer apparatus therebelow, or the like. This is accomplished in the shear-out safety joint 400 by the incorporation of a bridge which initially provides such a weight load carrying capability. The bridge may be removed to relax the capability for weight load carriage of the shear-out safety joint 400, such that it may thereafter operate as a conventional shear-out safety joint.

Figure 2:
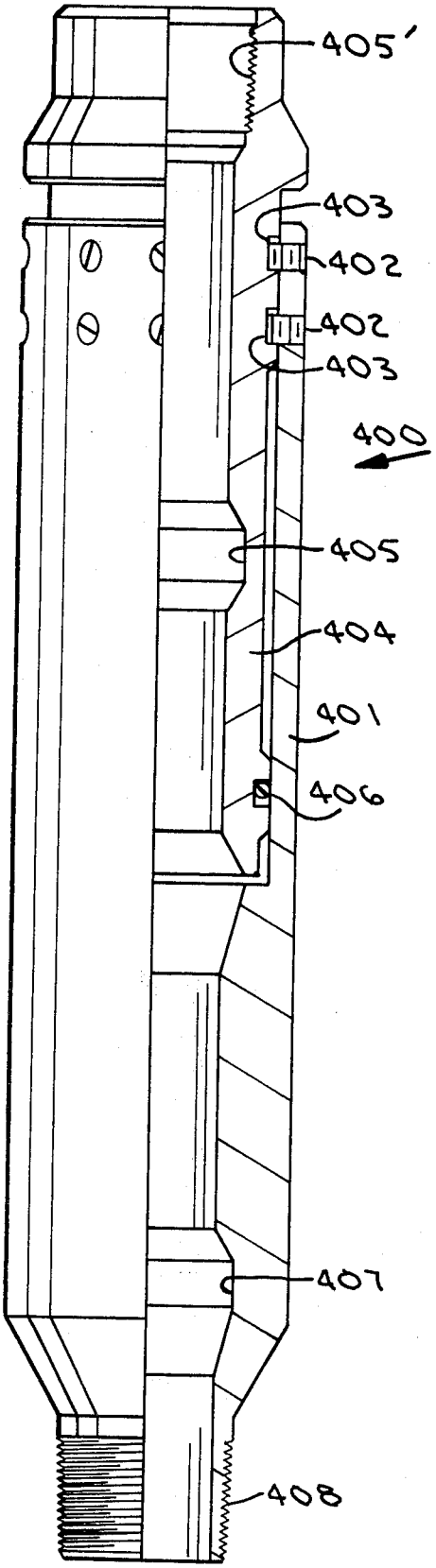
FIG. 2 is a view of the shear-out safety joint of the present invention after retrieval of the bridge element from the interior.
Figure 3:
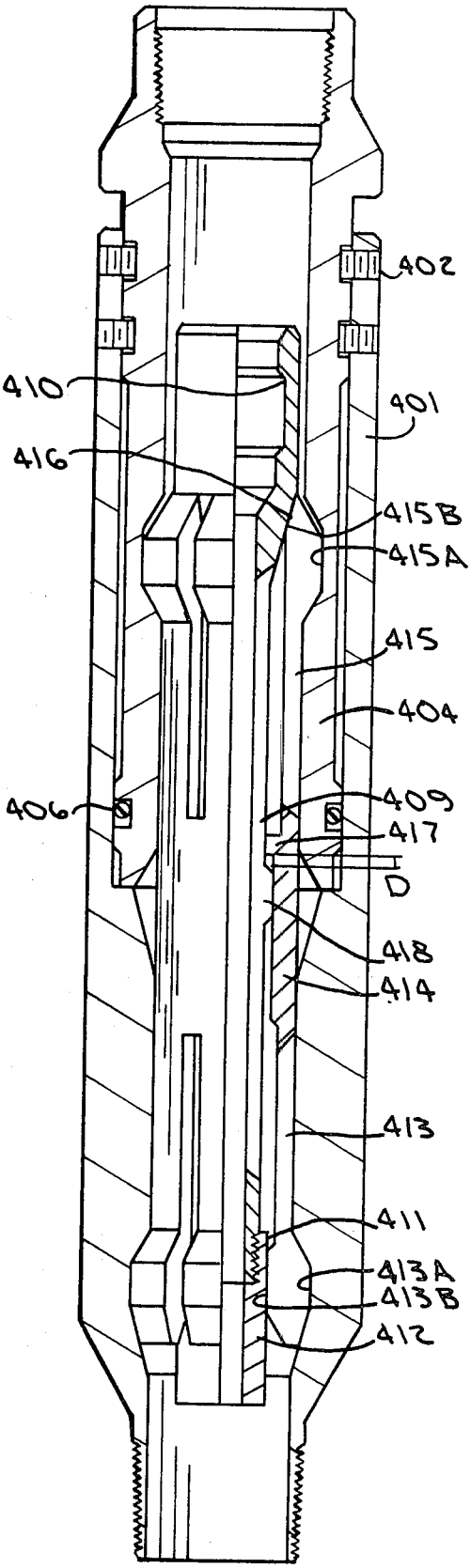
FIG. 3 is a view of the shear-out safety joint with the collet and the collet mandrel secured in place within the interior for transmitting a load through the shear-out safety joint in excess of the load held through the apparatus in the position as shown in FIG. 2.

The shear-out safety joint 400 shown in FIGS. 2 and 3 comprises an outer housing 401 which is secured by shear pins 402 to an inner housing 404, the shear pins 402 being respectively inserted within a positioned milled hole 403 exteriorly around the uppermost portion of the inner housing 404. It is this means of affixation which normally provides the shear-out feature of the safety joint 400, and permits torque in the tubing strings T-3 and T-4 to be transmitted across the safety joint 400.

Threads 405' secure the inner housing 404 to a section of the respective tubular string T-3 and T-4, thereabove. An elastomeric seal ring 406 is defined at the lowermost end of the inner housing 404 to prevent fluid communication between the housings 404 and 401. An upper collect profile 405 interiorly defined on the inner housing 404 and a companion lower collet profile 407 defined on the outer housing 401 serve to engage a collet 414 to define a bridge for initial weight load carrying capacity between the inner housing 404 and the outer housing 401. Threads 408 are defined exteriorly on the lowermost end of the outer housing 401 for affixation of the shear-out safety joint 400 to a section of tubular string therebelow of the respective tubing string T-3 or T-4.

As shown in FIG. 3, a control mandrel 409, cylindrical in nature, is housed interior of the inner housing 404 and the outer housing 401. The mandrel 409 is profiled at its upper end to define a fishing neck 410 for insertion thereon of the lower end of a fishing tool (not shown) manipulating by a wireline to retrieve the control mandrel 409 and the collet 414, thus removing the "bridge" and increased weight load carrying capacity of the shear-out safety joint 400, as described below. A short collet support 412 is secured by threads 411 to the lowermost end of the control mandrel 409, with an outwardly protruding shoulder 418 also being defined on the control mandrel 409 and being set a distance "D" slightly below an engaging shoulder 417 of the collet 414.

The collet 414 is secured between the control mandrel 409 and the housings 401 and 404 and has upwardly extending finger elements 415 having an outer surface 415A which is securely engaged within the collet profile 405 on the inner housing 404, while similarly constructed lower fingers 413 of the collet 414 have an outer surface 413A which also is engaged within a companion lower collet profile 407 on the lowermost portion of the outer housing 401.

The shoulder 417 on the collet 414 is above the shoulder 418 on the control mandrel 409, the distance "D", initially.

An interior shoulder, beveled, 415B on the upper finger 415 is engaged by a companion bevel 416 on the control mandrel 409 to urge the fingers 415 into the collet profile 405. A similar positioned elongated cylindrical exterior surface 413B on the collet support 412 urges the fingers 413 into the lower collet profile 407.

After the setting of the tubing hanger H, it will typically be desirable to reduce the weight load carrying capacity of the shear-out safety joint 400 by removing the "bridge" provided by the initial positioning of the control mandrel 409 and the collet 414 within the inner housing 401. Therefore, a conventional fishing tool is run by wireline and affixed to the fishing neck 410 of the control mandrel 409. The control mandrel 409 is pulled upwardly and as the distance "D" is contracted, the shoulder 418 on the control mandrel 409 will contact and engage the shoulder 417 on the control 414. Accordingly, the bevel 416 of the collet mandrel 409 and the interior surface 413B will be moved upwardly, correspondingly, to the amount of the distance "D", and beyond, in the up direction, thus enabling continued upward movement of the control mandrel 409 to urge the fingers 415 and 413 out of engagement with the respective collet profiles 405 and 407.

Since the shoulder 418 is part of the mandrel 409, when the mandrel 409 is pulled, the shoulder 418 is deflected inwardly until it passes through the shoulder 417. The mandrel then moves upward until the support 412 contacts the shoulder 417. The collet 414 is then pulled out of the housings 401 and 404 through this contact.

When the control mandrel 409, together with the collet 414, are released from the housings 404 and 401, and withdrawn from the strings T-3 and T-4 by wireline, the shear-out safety joint 400 now has the weight load carrying capability up to that defined through the shear pins 402. Additional weight load thereon, such as by applying additional pulling force through the respective tubing strings T-3 and T-4 will cause the shear pin 402 to be sheared, thus separating the inner housing 404 from the outer housing 401, and enabling retrieval of the respective tubing string together with the inner housing 404, and thereafter leaving the safety valves SV in place and, preferably, in the closed position for control of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In an apparatus connectable on a tubing string extendible into a subterranean well, said apparatus being selectively separatable whereby said tubing string may be parted, the improvement comprising: first means selectively retrievable from said apparatus for carrying across said apparatus a first weight load defined through said tubing string below said apparatus; and second weight load carrying means for carrying across said apparatus a second weight load defined through said tubing string below said apparatus, said second weight load carrying means comprising a shear pin initially engaged through said apparatus and selectively shearable thereacross for carrying across said apparatus a second weight load defined through said tubing string below said apparatus, said second weight load being less than said first weight load, said second weight load carrying means being activatable to separate said apparatus and said tubing string when said second weight load is exceeded.

2. The improvement of claim 1 wherein said first weight load is at least equal to the weight of the tubing string below said apparatus.

3. The improvement of claim 1 wherein said first weight load is substantially equal to the weight of the tubing string below said apparatus.

4. The improvement of claim 1 wherein said first means is extendible in said apparatus and comprises a collet selectively held on said apparatus by a mandrel means, said collet being disengagable from said apparatus upon manipulation of said mandrel.

5. The improvement of claim 4 wherein said mandrel is longitudinally shiftable to disengage said collet from said apparatus.

6. The improvement of claim 5 wherein said mandrel is longitudinally shiftable by means carried on wireline and extendible through said tubing string.

* * * * *